US011217411B2

(12) United States Patent
He et al.

(10) Patent No.: US 11,217,411 B2
(45) Date of Patent: Jan. 4, 2022

(54) METHODS FOR FORMING FUSE WITH SILICONE ELEMENTS

(71) Applicant: Suzhou Littelfuse OVS Co., Ltd., Suzhou (CN)

(72) Inventors: Dian He, Suzhou (CN); Tongshan Zhang, Suzhou (CN)

(73) Assignee: Suzhou Littelfuse OVC Co., Ltd, Suzhou (CN)

( * ) Notice: Subject to any disclaimer, the term of this patent is extended or adjusted under 35 U.S.C. 154(b) by 0 days.

(21) Appl. No.: 17/210,981

(22) Filed: Mar. 24, 2021

(65) Prior Publication Data

US 2021/0304996 A1 Sep. 30, 2021

(30) Foreign Application Priority Data

Mar. 31, 2020 (CN) ..... 202010245218.9

(51) Int. Cl.
*B05D 1/00* (2006.01)
*H01H 69/02* (2006.01)

(52) U.S. Cl.
CPC ..... *H01H 69/02* (2013.01); *B05D 1/62* (2013.01)

(58) Field of Classification Search
CPC ..... H01H 69/02
See application file for complete search history.

(56) References Cited

U.S. PATENT DOCUMENTS 3,179,773 A * 4/1965 Keeley, Sr. ..... H01H 85/0458 337/276
3,601,737 A * 8/1971 Baird ..... H01H 85/055 337/159
5,252,942 A * 10/1993 Gurevich ..... H01H 85/055 337/163
5,446,436 A * 8/1995 Williams ..... H01H 85/38 337/273
5,596,306 A * 1/1997 Kowalik ..... H01H 85/055 337/165
5,777,540 A * 7/1998 Dedert ..... H01H 85/143 257/665
6,507,265 B1 * 1/2003 Ackermann ..... H01H 85/10 337/278
2008/0192389 A1 * 8/2008 Muench ..... H02H 1/0023 361/5
2010/0207716 A1 * 8/2010 Yen ..... H01H 69/02 337/159
2017/0345605 A1 * 11/2017 Samuels ..... H01H 85/18
2018/0033578 A1 * 2/2018 Ogawa ..... H01H 85/0241

FOREIGN PATENT DOCUMENTS

WO 1996041360 12/1996

OTHER PUBLICATIONS

European Search Report dated Jul. 26, 2021 for European Patent Application No. 21166003.

* cited by examiner

*Primary Examiner* — Cachet I Proctor
(74) *Attorney, Agent, or Firm* — Kacvinsky Daisak Bluni PLLC

(57) ABSTRACT

Provided are approaches for forming a fusible element assembly, wherein an arc suppressant (e.g., silicone) is deposited on a fusible element. The arc suppressant is delivered to the fusible element at a plurality of angles.

17 Claims, 3 Drawing Sheets

METHODS FOR FORMING FUSE WITH SILICONE ELEMENTS

CROSS REFERENCE TO RELATED APPLICATION

This application claims the benefit of priority to, Chinese Patent Application 202010245218.9, filed Mar. 31, 2020, entitled "Method for Forming Fuse with Silicone Elements" which application is incorporated herein by reference in its entirety.

FIELD OF THE DISCLOSURE

The disclosure relates generally to circuit protection devices, more particularly, to methods for forming a fuse apparatus with silicone elements.

BACKGROUND OF THE DISCLOSURE

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible elements is connected between the fuse terminals, so that when electrical current flowing through the fuse exceeds a predetermined limit, the fusible element melts and opens one or more circuits through the fuse to prevent electrical component damage.

Electrical arcs occasionally develop along fusible elements, particularly at locations of melting in overcurrent conditions. The arcs can cause the housing, in which the fusible element is contained, to rupture if the arcs are allowed to persist for extended periods of time. To minimize the duration of an arcing event, fusible elements may be embedded in an arc-quenching material disposed within the housing, which absorbs the vaporized metal that sustains the arc over time. However, the arc-quenching material alone may be insufficient to expediently quench arcs generated within some fuses such as, for example, compact-size, higher-voltage, direct current (DC) fuses. It is thus desirable in some applications to supplement the arc-quenching capability of the fuse assembly.

SUMMARY

In some embodiments, an apparatus may include providing a fusible element, and depositing a silicone material on the fusible element, wherein the silicone material is delivered to the fusible element at a plurality of angles.

In some embodiments, a method for depositing a silicone material on a fusible element may include providing the fusible element, the fusible element including a series of solid sections connected by bridges, and depositing the silicone material on the fusible element. The silicone material may be delivered to the fusible element at a plurality of angles to form the silicone material along each of: a top surface of the fusible element, a bottom surface of the fusible element, and a side surface of the fusible element.

In some embodiments, a method of forming a fuse assembly may include providing a fusible element, and forming an arc suppression band about the fusible element, wherein a material of the arc suppression band is delivered to the fusible element at a plurality of angles.

Figure 1A:
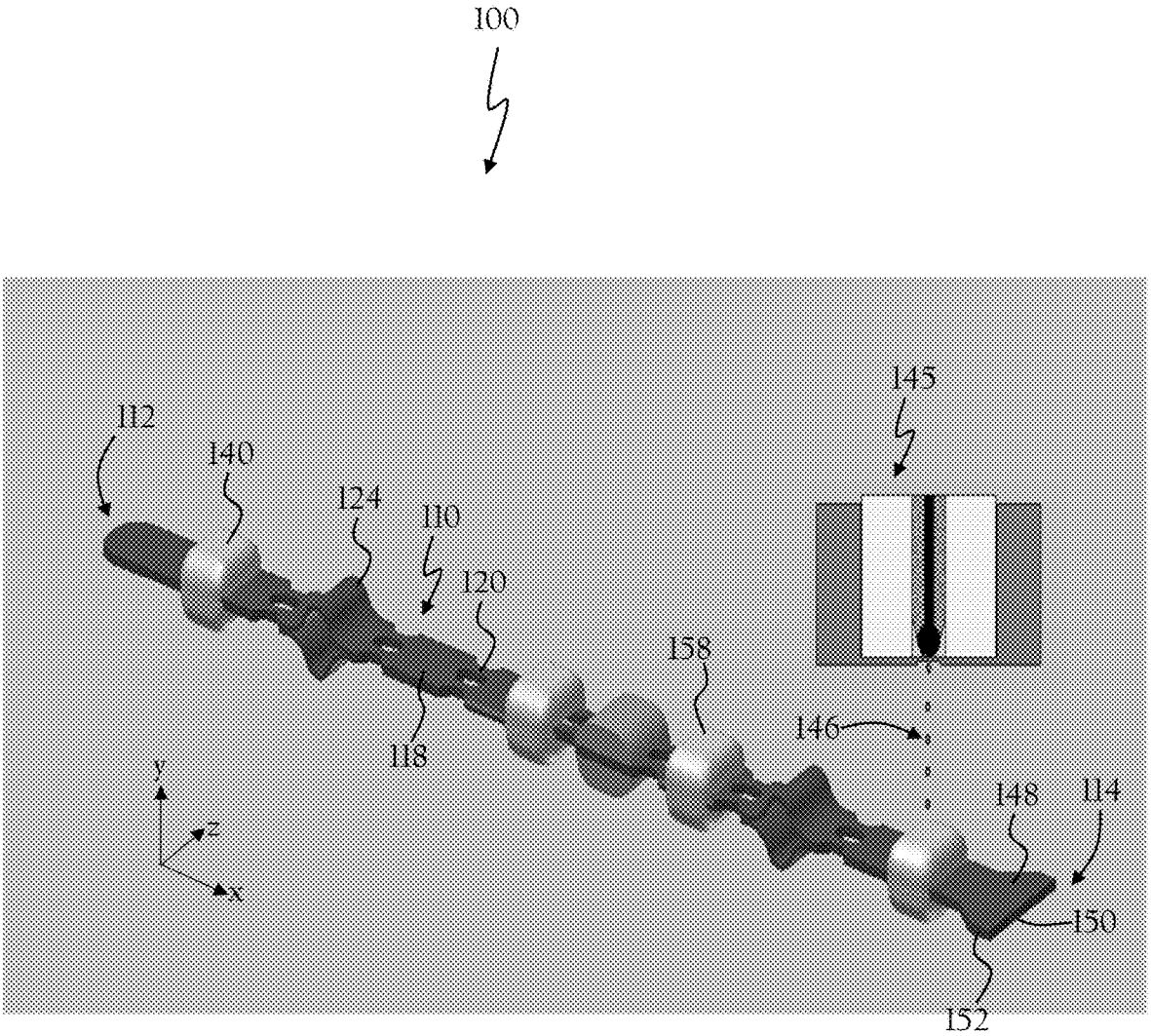
FIGS. 1A-1B are isometric views illustrating a fuse apparatus according to exemplary embodiments.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

Fuse apparatuses and assemblies in accordance with the present disclosure will now be described more fully hereinafter with reference to the accompanying drawings, in which embodiments of the system and method are shown. The fuse apparatuses and assemblies, however, may be embodied in many different forms and should not be construed as being limited to the embodiments set forth herein. Rather, these embodiments are provided so that this disclosure will be thorough and complete, and will fully convey the scope of the system and method to those skilled in the art.

Approaches herein provide a solution for forming silicone rings about a fusible element using a silicone jetting process. The silicone jetting process may include a jet dispenser repeatedly cycling on and off at high frequencies, thus breaking the silicone stream into a series of tiny beads or droplets. The jet dispenser may accelerate and deliver the silicone droplets on to the fusible element at a variety of angles. This silicone jetting process may be a non-contact and selective silicone forming process.

Figure 1B:
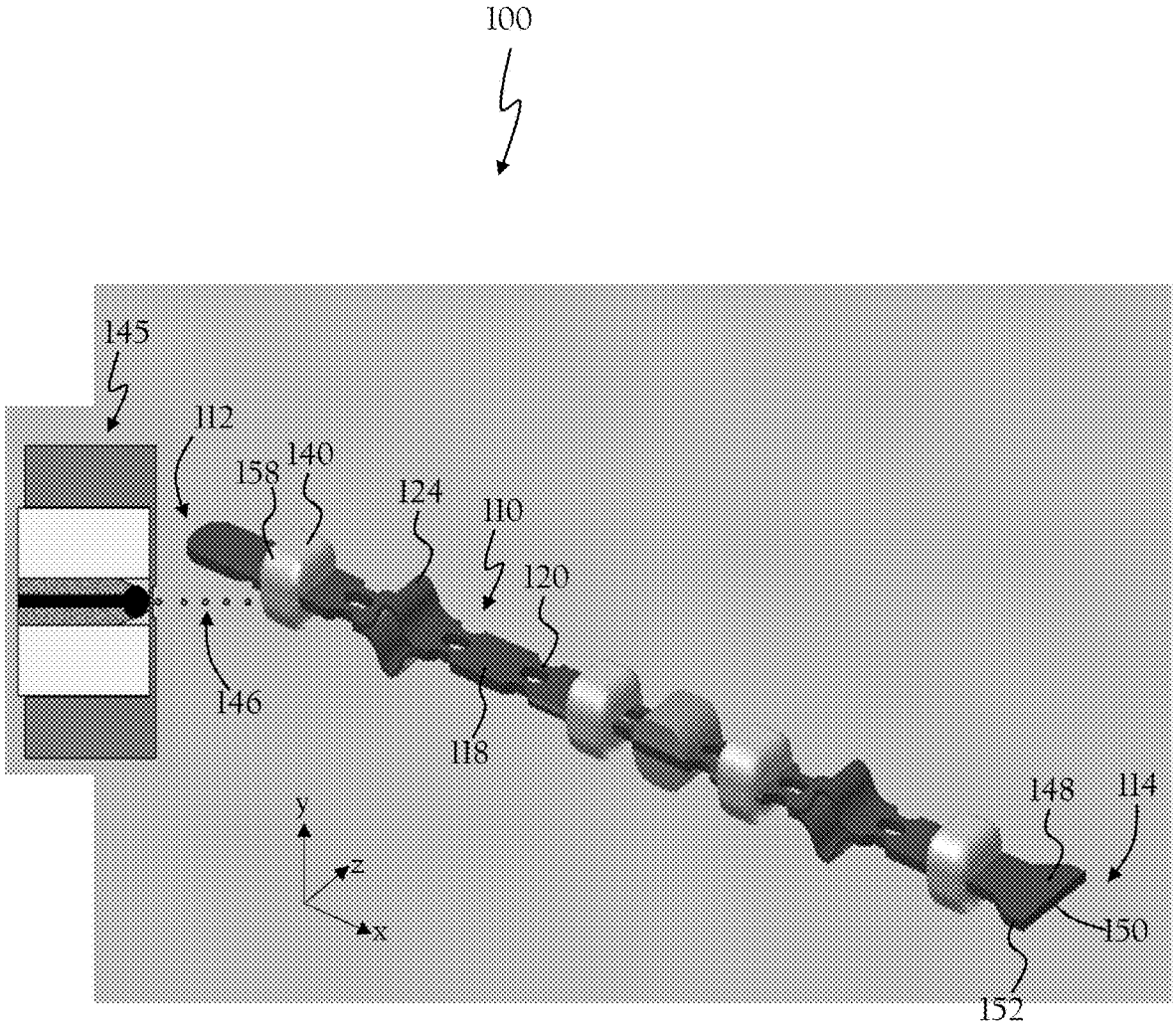

Referring to FIGS. 1A-1B, an exemplary embodiment of a fuse apparatus/assembly (hereinafter, "assembly") 100 in accordance with the present disclosure is shown. The exemplary assembly 100 may include one or more fusible elements 110 extending between a first end 112 and a second end 114. Although non-limiting, the fusible element 110 may be suitable within, for example, a cartridge fuse. In exemplary embodiments, the fusible elements 110 are contained within a housing (not shown). Although the fusible element 110 has a generally rectangular planform shape in the illustrated embodiment, the fusible element 110 may have any suitable planform shape in other embodiments. Furthermore, the fusible element 110 may be folded to define any suitable number of segments shaped and oriented relative to one another in any suitable manner to define any suitable surface contours.

In some embodiments, each of the fusible elements 110 may include a plurality of solid sections 118 joined together by electrically conductive bridges 120, which may include a set of openings provided therebetween. In various embodiments, the solid sections 118 and/or the electrically conductive bridges 120 may have a same or reduced thickness as compared to the rest of the fusible element 110. Furthermore, each of the fusible elements 110 may have a bent or curved shaped sections 124. Each of the fusible elements 110 may have a portion having a smaller cross-section, and/or an area having a lower melting point, such as tin, silver, lead, nickel, or an alloy thereof. Although not shown, the housing may include a filler adjacent the fusible elements 110. The various components of the housing may be made of an insulating material, such as an insulating plastic, e.g., nylon, glass-filled nylon, polyester and polycarbonate.

During operation of the assembly 100, electrical arcs may develop along the fusible element 110. The arcs tend to occur more frequently at the weakened conductive bridges 120. To address these arcs, the assembly 100 may further include a plurality of arc suppression discs or bands 140 formed about the fusible element 110. As shown, the suppression bands 140 may be formed at different points along the fusible element 110, between the first end 112 and the second end 114. In some embodiments, the bands 140 are formed out of a silicone material, which is delivered to the fusible element 110 via a plasma jet 145. The silicone material may be delivered as a series of droplets 146 by cycling the plasma jet 145 between 'ON' and 'OFF' states to interrupt the flow of silicone material. As shown, the plasma jet 145 may be spaced apart from the fusible element 110, thus making deposition selective and non-contact.

During formation of the bands 140, the fusible element and/or the plasma jet 145 may be rotated relative to one another such that the silicone material completely surrounds the fusible element 110. For example, the bands 140 may be formed along a top surface 148, a bottom surface 150, and each of the side surfaces 152. In some embodiments, the silicone material may be delivered while the plasma jet 145 is held at each of at least four different positions relative to the fusible element 110. As a result, the droplets 146 may be delivered to the fusible element 110 at a plurality of different angles to ensure a desired formation. Although non-limiting the bands 140 may generally take on a square, rectangular, or cuboid shape. In other embodiments, the bands 140 may generally take on a cylindrical or disc shape.

In some embodiments, the droplets 146 may be delivered to the fusible element 110 while the silicone material is in its liquid state. Thereafter, the silicone material may then be then cured (or otherwise permitted to harden) into a rigid or semi-rigid coating to form the bands 140. In an effort to not encapsulate too much of the fusible element 110 and, hence, to not impede the proper functionality of the fusible element 110, the bands 140 may be is attached only to select region(s) of the fusible element 110.

As shown in FIG. 1A, the droplets 146 may be delivered along a negative y-direction to form the silicone material atop the top surface 148 of the fusible element 110. As shown in FIG. 1B, the droplets 146 may be delivered along a positive x/z-direction to form the silicone material along the side surface 152 of the fusible element 110. In yet other embodiments, the plasma jet 145 may be oriented to deliver the droplets 146 onto a corner section 158 of the band 140. It will be appreciated that both the plasma jet 145 and the fusible element 110 may be translated, rotated, shifted, etc., relative to one another to dictate formation of the bands 140 along the fusible element 110.

Figure 2:
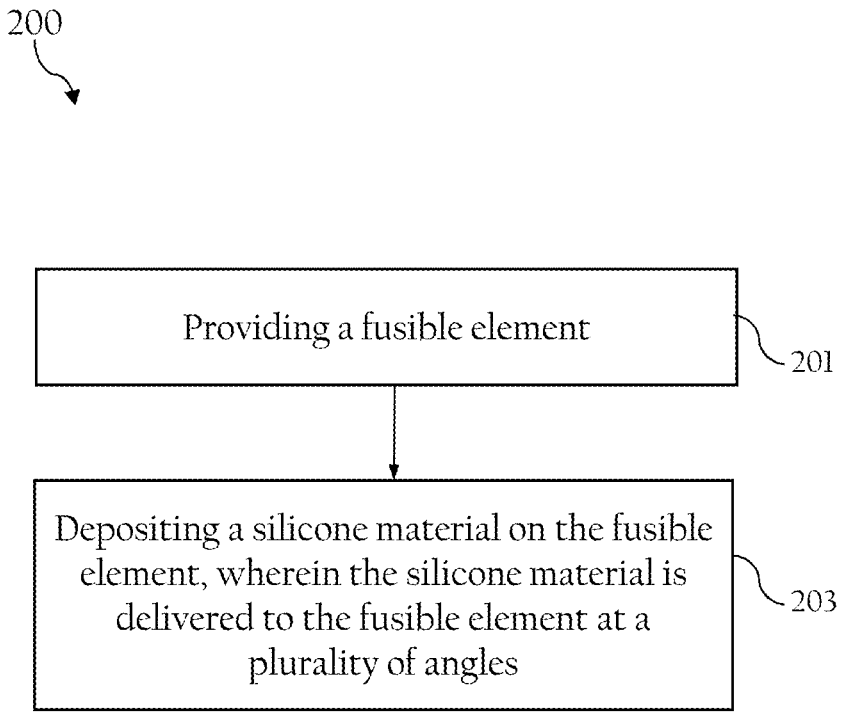
FIG. 2 is a flow chart of a method for forming a fuse apparatus according to exemplary embodiments.

Turning now to FIG. 2, a method 200 according to embodiments of the present disclosure will be described. At block 201, the method 200 may include providing a fusible element. In some embodiments, the fusible element may include a plurality of solid sections separated by bridges.

At block 203, the method 200 may include depositing a silicone material on the fusible element, wherein the silicone material is delivered to the fusible element at a plurality of angles. In some embodiments, the silicone material forms a plurality of bands around the fusible element. In some embodiments, the silicone material is formed along each of: a top surface of the fusible element, a bottom surface of the fusible element, and a side surface of the fusible element. In some embodiments, the silicone material is deposited using a plasma jet. In some embodiments, the method includes cycling the plasma jet between 'ON' and 'OFF' states while depositing the silicone material. In some embodiments, the method may include rotating the plasma jet and the fusible element relative to one another to form the silicone material about the fusible element. In some embodiments, the method may include depositing the silicone material as a series of droplets. In some embodiments, the method may further include spacing the plasma jet apart from the fusible element while the silicone material is deposited. In some embodiments, the method may include delivering the silicone material to the fusible element while the plasma jet is held at each of at least four different positions relative to the fusible element. In some embodiments, the method may include forming the silicone material around the fusible element at multiple points between a first end and a second end of the fusible element.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A method of forming a fuse assembly, comprising:
providing a fusible element; and
depositing a silicone material on the fusible element as a series of droplets, wherein the silicone material is delivered to the fusible element at a plurality of angles.

2. The method of claim 1, wherein the silicone material is formed along each of:
a top surface of the fusible element, a bottom surface of the fusible element, and a side surface of the fusible element.

3. The method of claim 1, further comprising depositing the silicone material using a plasma jet.

4. The method of claim 3, further comprising cycling the plasma jet between 'ON' and 'OFF' states while depositing the silicone material.

5. The method of claim 3, further comprising rotating the plasma jet and the fusible element relative to one another to form the silicone material about the fusible element.

6. The method of claim 3, further comprising spacing the plasma jet apart from the fusible element while the silicone material is deposited.

7. The method of claim 3, further comprising delivering the silicone material to the fusible element while the plasma jet is held at each of at least four different positions relative to the fusible element.

8. A method for depositing a silicone material on a fusible element, comprising:
providing the fusible element, the fusible element including a series of solid sections connected by bridges; and
depositing the silicone material on the fusible element as a series of droplets, wherein the silicone material is delivered to the fusible element at a plurality of angles to form the silicone material along each of: a top surface of the fusible element, a bottom surface of the fusible element, and a side surface of the fusible element.

9. The method of claim 8, further comprising depositing the silicone material using a plasma jet.

10. The method of claim 9, further comprising cycling the plasma jet between 'ON' and 'OFF' states while depositing the silicone material.

11. The method of claim 9, further comprising rotating the plasma jet and the fusible element relative to one another to form the silicone material about the fusible element.

12. The method of claim 9, further comprising separating the plasma jet from the fusible element while the silicone material is deposited.

13. The method of claim 9, further comprising delivering the silicone material to the fusible element while the plasma jet is held at each of at least four different positions relative to the fusible element.

14. The method of claim 8, further comprising forming the silicone material around the fusible element at multiple points between a first end and a second end of the fusible element.

15. A method of forming a fuse assembly, comprising:
providing a fusible element; and
forming an arc suppression band about the fusible element, wherein a material of the arc suppression band is delivered to the fusible element at a plurality of angles;
wherein forming the arc suppression band comprises depositing a silicone material as a series of droplets on the fusible element using a plasma jet, and wherein the silicone material is deposited while the plasma jet and the fusible element are rotated relative to one another.

16. The method of claim 15, further comprising forming the arc suppression band along each of: a top surface of the fusible element, a bottom surface of the fusible element, and a side surface of the fusible element.

17. The method of claim 15, further comprising cycling the plasma jet between 'ON' and 'OFF' states to deposit the silicone material as the series of droplets.

* * * * *